US005196813A

United States Patent [19]

Nakakubo

[11] Patent Number: 5,196,813

[45] Date of Patent: Mar. 23, 1993

[54] DIELECTRIC FILTER HAVING A SINGLE MULTILAYER SUBSTRATE

[75] Inventor: Hideaki Nakakubo, Higashiosaka, Japan

[73] Assignee: Matsushita Electric Industrial Co., Ltd., Osaka, Japan

[21] Appl. No.: 734,574

[22] Filed: Jul. 23, 1991

[51] Int. Cl.[5] ..... H01P 1/202; H01P 1/205

[52] U.S. Cl. ..... 333/206; 333/246

[58] Field of Search ..... 333/202, 204, 206, 207, 333/222, 246; 361/328, 414, 412

[56] References Cited

U.S. PATENT DOCUMENTS 4,987,393 1/1991 Yorita et al. ..... 333/202
5,036,301 7/1991 Takao et al. ..... 333/246 X
5,045,824 9/1991 Metroka ..... 333/202 X

FOREIGN PATENT DOCUMENTS 0053603 3/1989 Japan ..... 333/202
0062101 3/1990 Japan ..... 333/202
0241202 9/1990 Japan ..... 333/202

*Primary Examiner*—Paul M. Dzierzynski
*Assistant Examiner*—Seung Ham
*Attorney, Agent, or Firm*—Ratner & Prestia

[57] ABSTRACT

A dielectric filter having a plurality of dielectric coaxial resonators and a multilayer substrate comprising a plurality of dielectrics layers and a plurality of electrically conductive patterns, wherein the dielectric coaxial resonators are positioned against a front surface of the multilayer substrate and are electrically connected in parallel through first capacitors formed by the electrically conductive patterns of the multilayer substrate, a series connection of a second capacitor, a strip line and a third capacitor or a series connection of a second capacitor, an inductance element and a third capacitor formed by the electrically conductive patterns of the multilayer substrate is electrically connected in parallel relative to the first capacitors. The filter is small and can be manufactured in a reduced number of man-hours.

2 Claims, 6 Drawing Sheets

DIELECTRIC FILTER HAVING A SINGLE MULTILAYER SUBSTRATE

BACKGROUND OF THE INVENTION

1. Field of the Invention

The present invention relates to a dielectric filter which can be used in various applications, such as a communication system.

2. Description of Prior Art

In order to obtain desirable filter characteristics, a typical prior art dielectric filter, as shown in FIG. 5 and FIG. 6, has a structure, wherein a plurality of dielectric coaxial resonators 1 are electrically connected in parallel in such a manner that metal connectors 3 are connected in parallel through first capacitors 17 formed on an alumina ceramic substrate 22. Substrate 22 is provided with input-output terminals 2. A series connection of a second capacitor 18, a strip line 23 and a third capacitor 20 is formed on an attenuation pole substrate 21 and is connected in parallel relative to the first capacitors 17.

However, the conventional filter of the above arrangement has a drawback in that the alumina ceramic substrate 22 and the attenuation pole substrate 21 are assembled in a double stage construction. This results in a large size. In addition, it is difficult to keep the alumina ceramic substrate 21 and the attenuation pole substrate 21 parallel with each other. This difficulty increases the number of man-hours required in the assembly stage.

SUMMARY OF THE INVENTION

The present invention solves the above mentioned problem. An object of the present invention is to provide a dielectric filter which is small in size and which can be manufactured in a reduced number of man-hours.

This object is attained by the present invention which provides a dielectric filter comprising:

(a) a plurality of dielectric coaxial resonators;

(b) a multilayer substrate consisting essentially of (1) a first conductive pattern, a first dielectric layer and a second conductive pattern, whereby a second capacitor, a stripline and a third capacitor are formed and connected in series with one another, (2) a third conductive pattern, a third dielectric layer and a fourth conductive pattern, whereby a plurality of first capacitors is formed and connected in series, and (3) a second dielectric layer being placed between said second conductive pattern and said third conductive pattern and having a smaller dielectric constant than that of said first and third dielectric layers;

(c) a plurality of metal connectors which connect the dielectric coaxial resonators to electrodes of the first capacitors; and (d) two terminals each of which connects to one of the two outside most electrodes of the first capacitors, respectively.

In accordance with the present invention, one multilayer substrate is employed instead of two conventionally used substrates, namely an alumina ceramic substrate and an attenuation pole substrate. Accordingly, the present invention provides a dielectric filter of a reduced height and a small size.

DETAILED DESCRIPTION OF THE DRAWINGS

Embodiments of the invention will now be described by way of example only, in conjunction with the attached drawings in which.

DETAILED DESCRIPTION OF THE INVENTION

First Embodiment

Figure 1:
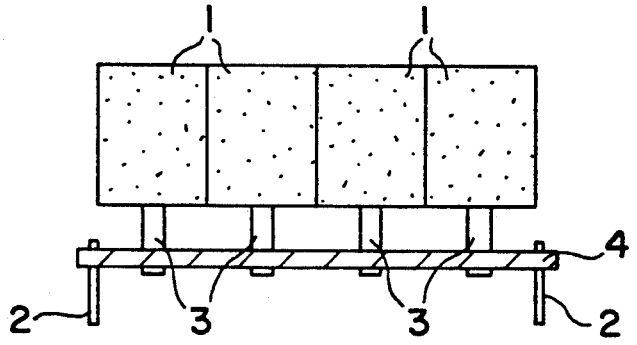
FIG. 1 is a front view of a first embodiment and a second embodiment showing a dielectric filter structure according to the present invention.
Figure 4:
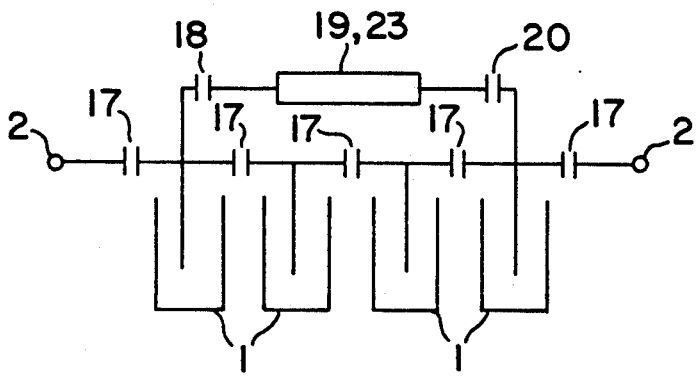
FIG. 4 is an equivalent circuit diagram of the embodiments of the present invention.
Figure 5:
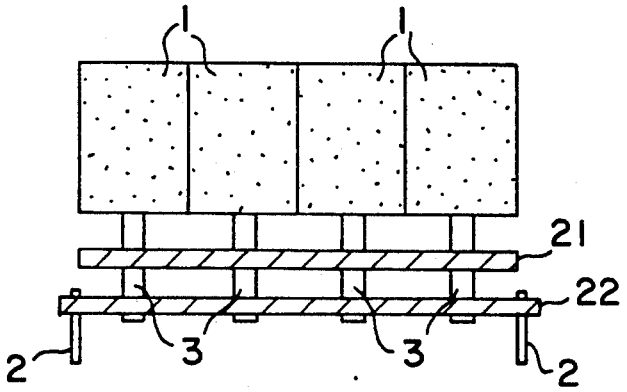
FIG. 5 PRIOR ART
FIG. 5 is a front view showing a prior art dielectric filter structure.
Figure 6:
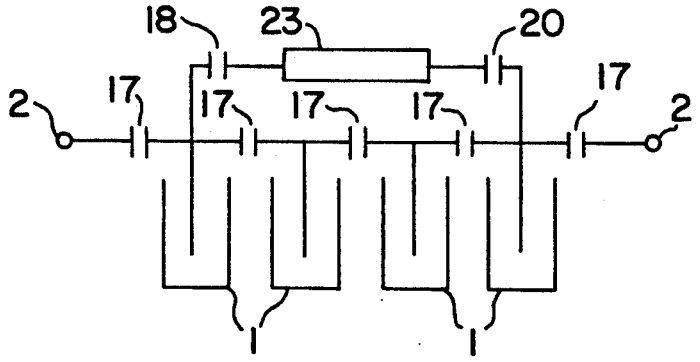
FIG. 6 PRIOR ART
FIG. 6 is a circuit diagram of the prior art filter.

In the first embodiment, as shown in FIG. 1 and FIG. 4, a plurality of dielectric coaxial resonators 1 are positioned by means of metal connectors 3 against a front surface of a multilayer substrate 4 equipped with input-output terminals 2, the resonators 1 are connected in parallel by means of first capacitors 17, and a series connection of a second capacitor 18, a strip line 23 and a third condenser 20 formed on the multilayer substrate 4 is connected in parallel relative to the first capacitors 17.

Figure 2:
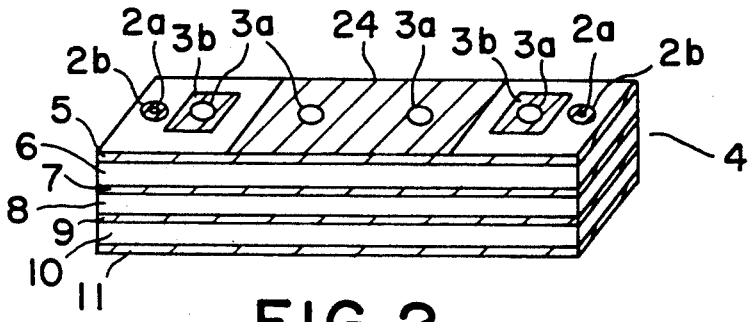
FIG. 2 is a perspective view from the front surface side of a multilayer substrate structure used in the first embodiment.

FIG. 2 shows the multilayer substrate 4 of the first embodiment which has a laminated structure comprising a first layer of electrically conductive pattern 5, a first dielectrics 6, a second layer of electrically conductive pattern 7, a second dielectrics 8, a third layer of electrically conductive pattern 9, a third dielectrics 10, and a fourth layer of electrically conductive pattern 11. The multilayer substrate 4 also has input-output terminal holes 2*a*, input-output terminal electrodes 2*b*, metal connector holes 3*a*, and metal connector electrodes 3*b*.

Figure 7:
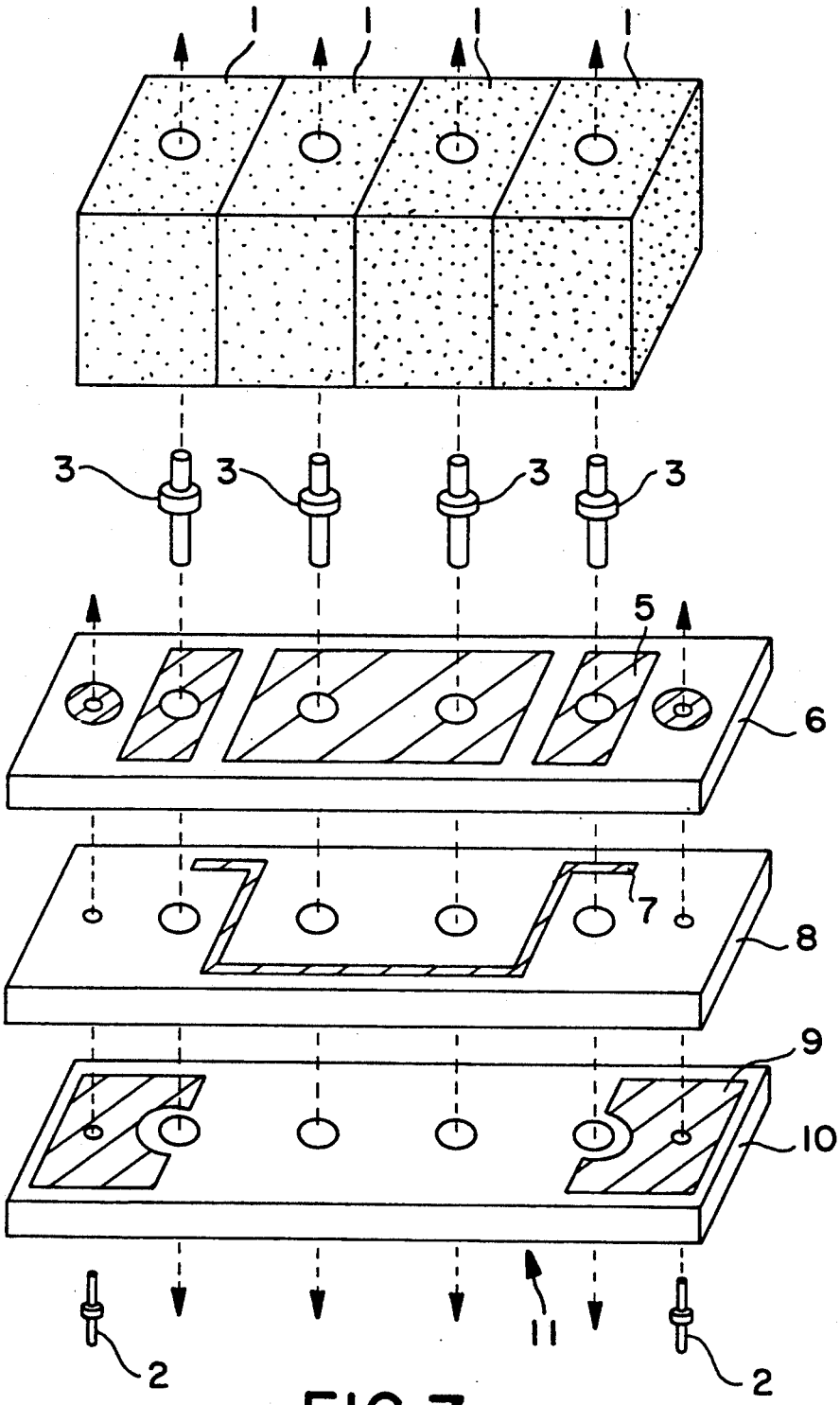
FIG. 7 shows an exploded perspective view of the dielectric filter described in the First Embodiment of the specification of the present invention.
Figure 8A:
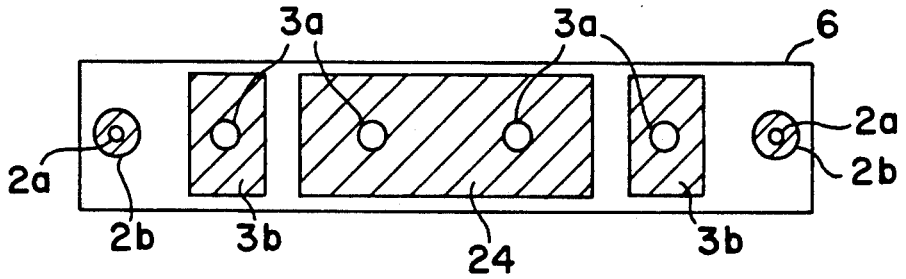
FIGS. 8(*a–d*) shows each conductive pattern of the multilayer substrate shown in FIG. 7.
Figure 8B:
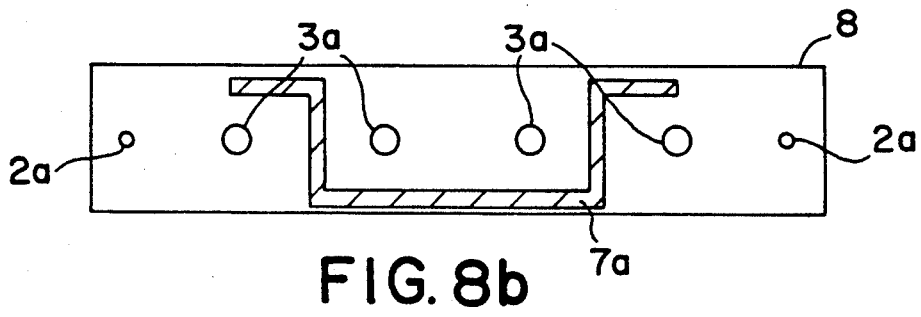
Figure 8C:
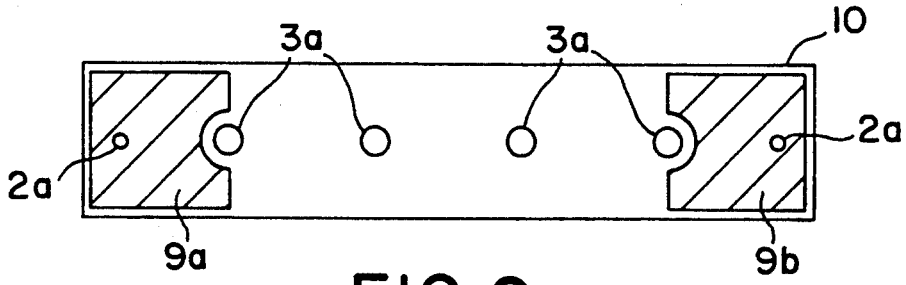
Figure 8D:
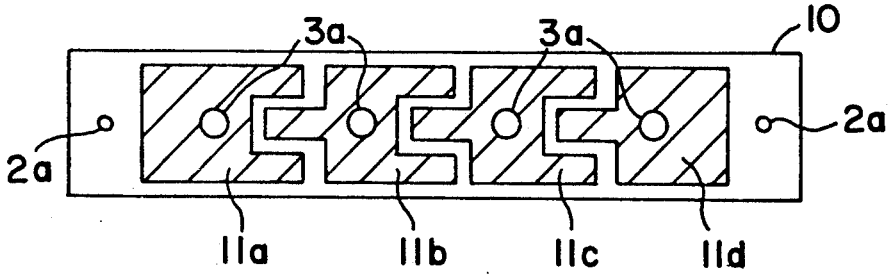

As shown in FIG. 7, the dielectric filter according to the first embodiment of the present invention includes resonators 1, metal connectors and dielectrics 6, 8 and 10. Terminals 2 are also included.

A first, second, third and fourth conductive pattern made of a conductive material like a copper foil are formed on the surfaces of each dielectric layer. The first conductive pattern 5 consists of two terminal electrodes 2*b*, one for input and the other for output, two connecting electrodes 3*b* and a grounding electrode 24, as shown in FIG. 8(*a*).

The second conductive pattern 7 consists of a strip 7*a* which also acts as electrodes for capacitors 18 and 20, as shown in FIG. 8(*b*).

The third conductive pattern 9 consists of electrodes 9*a* and 9*b*, as shown in FIG. 8(*c*).

The fourth conductive pattern 11 consists of electrodes 11*a*, 11*b*, 11*c* and 11*d*, as shown in FIG. 8(*d*).

Five capacitors 17 consist of five pairs of electrodes and a third dielectric layer 10. The five pairs of electrodes are a pair of electrodes 9*a* and 11*a*, a pair of electrodes 11*a* and 11*b*, a pair of electrodes 11*b* and 11*c*, a pair of electrodes 11*c* and 11*d* and a pair of electrodes 11*d* and 9*b*.

The electrodes 9*a* and 9*b* are connected to one of terminals 2, respectively, and the electrodes 11*a*, 11*b*, 11*c* and 11*d* are connected to one of metal connectors 3, respectively.

Capacitors 18 and 20 consist of two connecting electrodes 3*b*, a strip 7*a* and a first dielectric layer 6. The connecting electrodes 3*b* are connected to two of the connectors 3, located in the extreme right and the extreme left sides, respectively.

A stripline 23 consists of a grounding electrode 24, the first dielectric layer 6 and the strip 7*a*. The grounding electrode 24 connects to a chassis (not shown).

A material of high dielectric constant is used for the first layer dielectrics 6 and the third layer dielectrics 10, while a material of low dielectric constant is used for the second layer dielectrics 8. This prevents an unwanted capacitive coupling at the second layer conductive pattern 7 and the third layer conductive pattern 9.

Thus, the first embodiment has a structure wherein a plurality of dielectric coaxial resonators are connected to the front surface of the multilayer substrate having the first capacitor, the second condenser, the third condenser and the strip line. Because of this structure, the filter can be easily assembled, which reduces the number of man-hours required for assembly, and the overall height of the filter can be made low, which reduces the filter size.

Second Embodiment

The second embodiment of the present invention has the structure shown in FIG. 1 and FIG. 4, but is different from the first embodiment in that the second embodiment uses an inductance 19 in place of the strip line 23 of the first embodiment.

Figure 3:
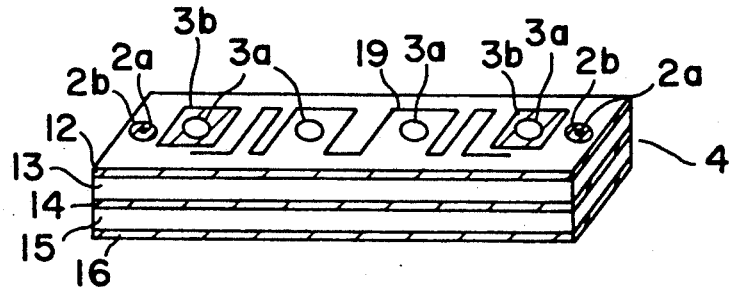
FIG. 3 is a perspective view from the front surface side of another multilayer substrate structure used in the second embodiment.

FIG. 3 shows the multilayer substrate 4 of the second embodiment which has a laminated structure comprising a first layer of electrically conductive pattern 12, a first dielectrics 13, a second layer of electrically conductive pattern 14, a second dielectrics 15, and a third layer of electrically conductive pattern 16. The multilayer substrate 4 also has input-output terminal holes 2*a*, input-output terminal electrodes 2*b*, metal connector holes 3*a*, and metal connector electrodes 3*b*.

Figure 9:
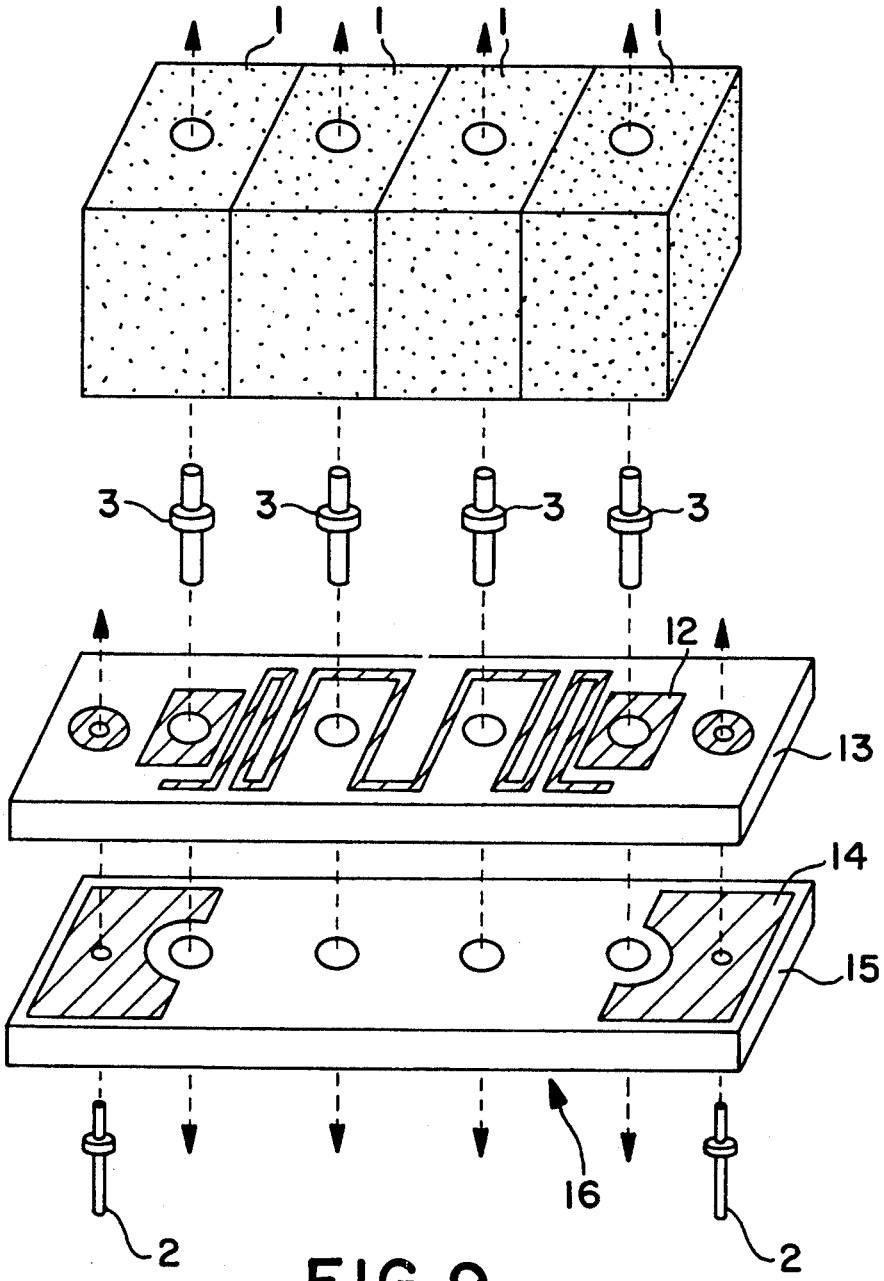
FIG. 9 shows an exploded perspective view of the dielectric filter described in the Second Embodiment of the specification of the present invention.

As shown in FIG. 9, the dielectric filter according to the second embodiment of the present invention includes resonators 1, metal connectors 3 and dielectrics 13 and 15. Terminals 2 are also included.

Figure 10A:
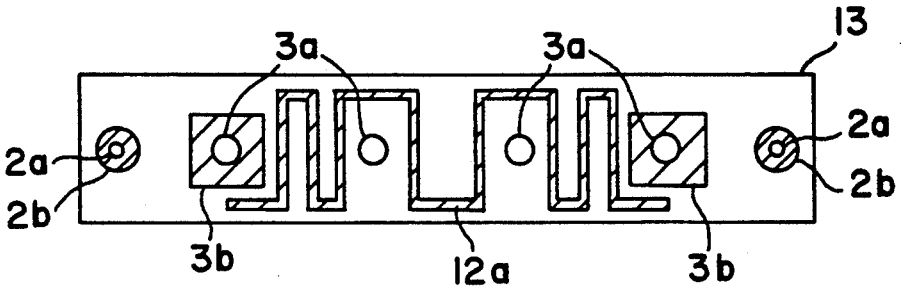
FIGS. 10(*a–d*) shows each conductive pattern of the multilayer substrate shown in FIG. 9.
Figure 10B:
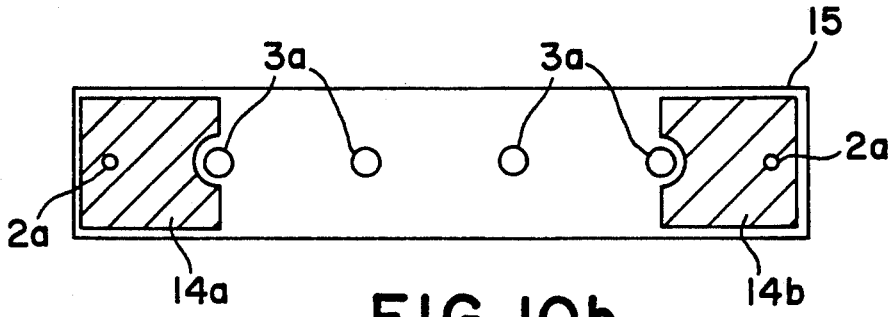
Figure 10C:
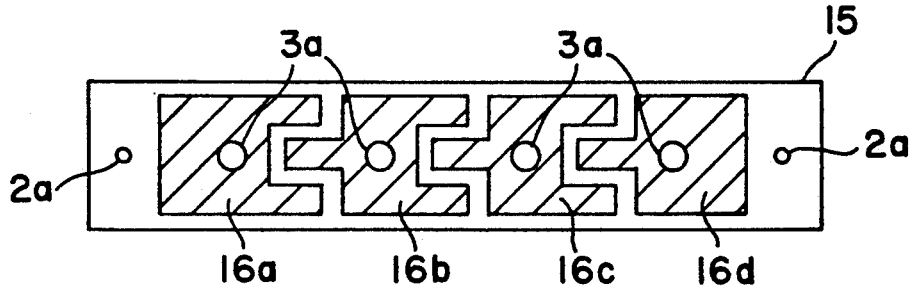

First conductive pattern 12 consists of two terminal electrodes 2*b*, connecting electrodes 3*b* and an inductance pattern 12*a* with the shape of a rectangular wave, as shown in FIG. 10(*a*).

Second conductive pattern 14 in FIG. 10(*b*) and third conductive pattern 16 in FIG. 10(*c*) are equivalent to those in FIG. 8(*c*) and FIG. 8(*d*), respectively.

Therefore, the construction of capacitors 17 is similar to the first embodiment.

Capacitor 18 consists of one of connecting electrodes 3*b* located in left side and the left side part of the inductance pattern 12*a*. Capacitor 20 consists of the other connecting electrode 3*b* and the right side part of the inductance pattern 12*a*.

Inductor 19 consists of the inductance pattern 12*a*.

Connection of the terminals 2 and connectors 3 to the conductive patterns 12, 14 and 16 is similar to the connections according to the first embodiment.

A high dielectric constant material is used for the second dielectrics 15, while a low dielectric constant material is used for the first dielectrics 13. This prevents an unwanted capacitive coupling at the first layer conductive pattern 12 and the second layer conductive pattern 14.

Thus, the second embodiment has a structure wherein a plurality of dielectric coaxial resonators are connected to the front surface of the multilayer substrate having the first capacitor, the second capacitor, the third capacitor and the inductance. Because of this structure, the filter can be easily produced, which reduces the number of man-hours required for production, and the overall height of the filter can be made low, which reduces the filter size.

As mentioned previously, in the filter of the present invention, a plurality of dielectric coaxial resonators are connected to the front side of a multilayer substrate having a first capacitor, a second capacitor, a third capacitor and a strip line or an inductance. This structure provides an excellent filter having a small size and which is capable of being produced in a reduced number of man-hours.

What is claimed is:

1. A dielectric filter comprising:

a) a plurality of dielectric coaxial resonators;

b) a multilayer substrate comprising:

a first dielectric layer having a first conductive pattern deposited thereon; a second dielectric layer having a second conductive pattern deposited thereon; a third dielectric layer having both a third conductive pattern and a fourth conductive pattern deposited thereon and said third dielectric layer is located between said third conductive pattern and said fourth conductive pattern; said third conductive pattern, said third dielectric layer and said fourth conductive pattern forming a plurality of first capacitors having a plurality of electrodes, said plurality of first capacitors arranged in series connection;

said first conductive pattern, said first dielectric layer and said second conductive pattern forming a second capacitor, a stripline and a third capacitor arranged in series connection;

said second dielectric layer located between said second conductive pattern and said third conductive pattern;

said second dielectric layer having a dielectric constant smaller than each of said first dielectric layer and said third dielectric layer;

c) a plurality of metal connectors, each of said plurality of metal connectors connecting a respective one of said plurality of dielectric coaxial resonators to a respective one of said plurality of first capacitors; and d) two terminals, one of said two terminals connected to one of said electrodes included in one of said plurality of first capacitors, the other of said two terminals connected to one of said electrodes included in another one of said plurality of first capacitors.

2. A dielectric filter comprising:

a) a plurality of dielectric coaxial resonators;

b) a multilayer substrate comprising:

a first dielectric layer having a first conductive pattern deposited thereon to form a second capacitor, an inductor and a third capacitor arranged in series connection;

a second dielectric layer having both a second conductive pattern and a third conductive pattern deposited thereon and said second dielectric layer located between said second conductive pattern and said third conductive pattern to form a plurality of first capacitors having a plurality of electrodes, said plurality of first capacitors arranged in series connection;

said second dielectric layer having a dielectric constant larger than said first dielectric layer;

c) a plurality of metal connectors, each of said plurality of metal connectors connecting a respective one of said plurality of dielectric coaxial resonators to a respective one of said plurality of first capacitors; and d) two terminals, one of said two terminals connected to one of said electrodes included in one of said plurality of first capacitors, the other of said two terminals connected to one of said electrodes included in another one of said plurality of first capacitors.

* * * * *